United States Patent [19]

Viola et al.

[11] 4,375,053

[45] Feb. 22, 1983

[54] INTERLEVEL STRIPLINE COUPLER

[75] Inventors: Raymond D. Viola, Oyster Bay; Gerard L. Hanley, Melville, both of N.Y.

[73] Assignee: Sperry Corporation, New York, N.Y.

[21] Appl. No.: 220,227

[22] Filed: Dec. 29, 1980

[51] Int. Cl.[3] ..... H01P 5/18

[52] U.S. Cl. ..... 333/116; 333/35; 333/238; 333/246

[58] Field of Search ..... 333/116, 128, 238, 246

[56] References Cited

U.S. PATENT DOCUMENTS 3,012,210 12/1961 Nigg ..... 333/116
3,568,098 3/1971 Gerst ..... 333/116
3,626,332 12/1971 Barbatoe ..... 333/116
3,715,689 2/1973 Laughlin ..... 333/128

OTHER PUBLICATIONS

RCA Technical Notes, TN No. 987, Nov. 26, 1974, RCA, Princeton, N.J., *3db Directional Coupler.*

*Primary Examiner*—Paul L. Gensler
*Attorney, Agent, or Firm*—Howard P. Terry; Seymour Levine

[57] ABSTRACT

Stripline interlevel couplers capable of power splitting signals incident thereto at a given level of a multilevel stripline circuit between a plurality of levels and of coupling such incident signals between levels substantially unattenuated.

7 Claims, 13 Drawing Figures

INTERLEVEL STRIPLINE COUPLER

BACKGROUND OF THE INVENTION

1. Field of the Invention

The invention pertains to stripline couplers and more particularly to interlevel stripline couplers for coupling between levels of multilevel stripline circuits.

2. Description of the Prior Art

Many stripline circuits require strip conductors in a common plane to cross, thus establishing crossovers that are difficult to effectuate in a one level stripline configuration. In the prior art, these crossovers are generally accomplished with multilevel stripline circuits and interlevel connections. A multilevel system is designed and one of the crossing lines is transformed to another level to effectuate the crossing, thus establishing a need for interlevel coupling. Prior art systems utilized metal connecting pins between the levels on which the striplines to be connected are located and soldering the striplines center conductors to these interlevel connecting pins. This operation is difficult and presents many assembly problems. Additionally, the resulting connections generally cause amplitude and phase variations to occur to the signals coupled. For many applications these amplitude and phase variations are within tolerance limits and acceptable performances are provided. In applications, however, wherein extremely tight tolerances are required, the random phase shifts and junction losses realized through a multiplicity of interlevel connections adversely affect the network responses and unacceptable performances result. What is required is an interlevel coupling system that eliminates the interlevel connecting pins and the soldering thereto.

SUMMARY OF THE INVENTION

An interlevel coupling network constructed in accordance with the principles of the present invention includes three regions located between upper and lower ground planes. The planes between the middle region and the upper and lower regions comprise two levels of an asymmetrical stripline system. At each level, in appropriate registry for energy coupling therebetween, are horseshoe shaped inner conductors positioned to have the arcuate and open end sections of one in juxtaposition with the open end and arcuate sections of the other. Line lengths of the various portions of the horse shoe shaped inner conductors may be chosen to provide a four terminal device in which signals of equal amplitude but in phase quadrature are coupled to output terminals located on different levels in response to a signal incident to an input port positioned at one of the levels while maintaining isolation between the input terminal and a fourth terminal located on the other level. Providing two such circuits in tandem establishes substantially unattenuated coupling between an input terminal at one level and an output port at the other level. An unattenuated level coupler may also be provided by establishing open circuits at the equal amplitude phase quadrature output terminals and utilizing the originally isolated terminal as the output terminal. Electrical isolation between levels is provided by positioning a ground plane substantially equidistant between the upper and lower ground planes at appropriate locations to create two half height asymmetrical stripline circuits, thus allowing lines at one level to cross lines at the other level without affecting the signal flow in either line.

Suppression of the parallel plate mode between the inserted ground plane and an original ground plane is accomplished by appropriately positioning metallic blocks in electrical contact with the original ground plane and the inserted ground plane.

DESCRIPTION OF THE PREFERRED EMBODIMENT

Figure 1:
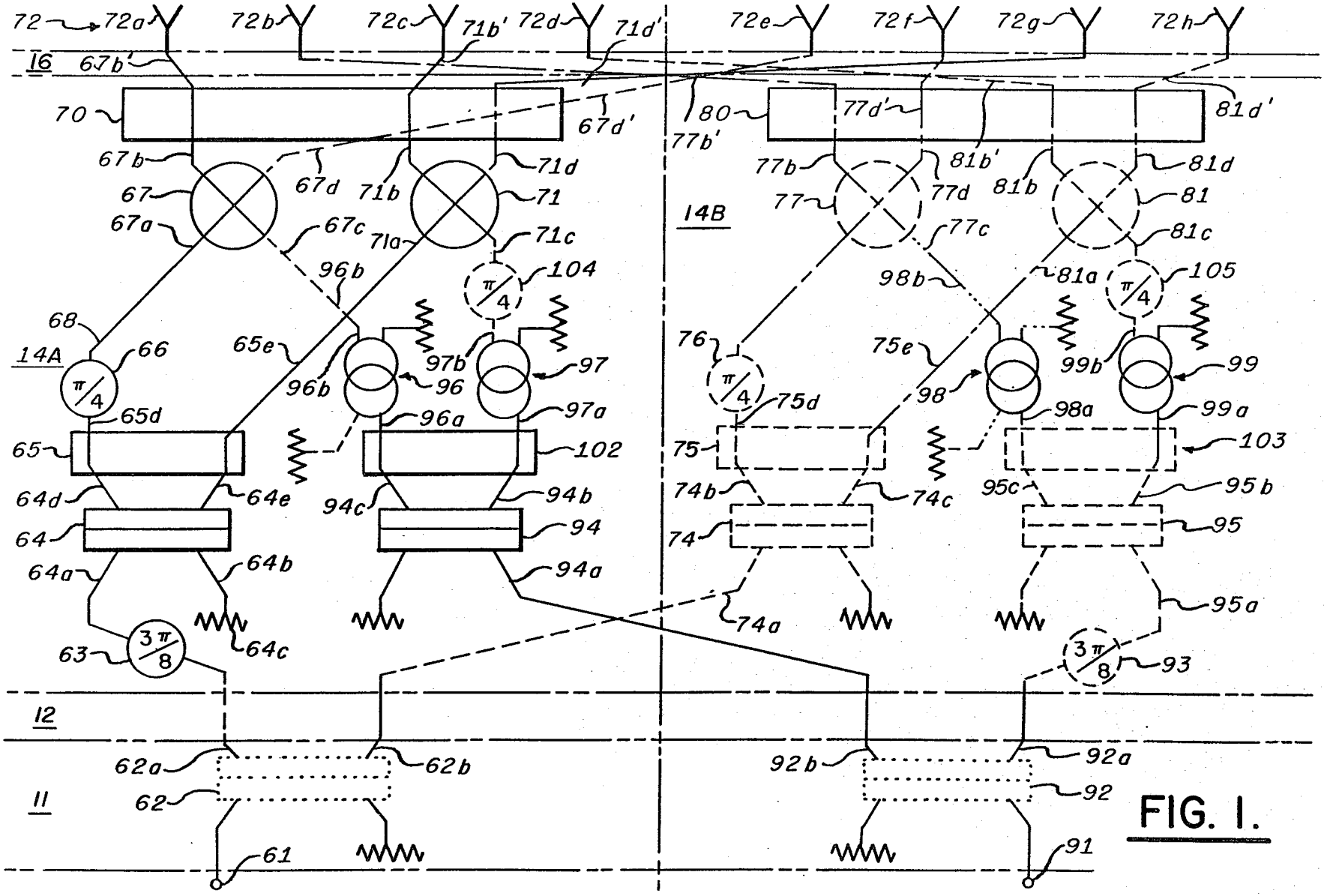
FIG. 1 is a schematic diagram of a two beam eight element array utilizing the principles of the present invention.

The invention has application in many stripline systems, one of which will be described with reference to FIG. 1, wherein a schematic diagram of a two beam eight antenna element Butler beam forming network is shown.

A signal incident to input port 61 of a three branch 3 dB coupler 62 of power divider 11 is coupled therefrom to output transmission lines 62*a* and 62*b* as signals in quadrature relationship and of equal amplitude. Throughout this discussion, the convention will be used that the phase shift straight through the directional coupler, such as from input port 61 to output line 62*b*, is 90 degrees while the phase shift in the coupled arm, such as from input port 61 to output transmission line 62*a*, is 0 degrees. Output transmission lines 62*a*, 62*b* are coupled to a deck level transformer 12, such as that described in our corresponding U.S. patent application Ser. No. 220,226, and therefrom respectively to decks 14A and 14B. Transmission line 62*a* is coupled in deck 14A through a $67\frac{1}{2}°$ phase shifter 63, which may be of the Schiffman type well known in the art, to an input transmission line 64*a* of a three branch 3 dB coupler 64, constructed in symmetrical stripline, for which a second input port 64*b* is coupled to a matched termination 64*c*. The output transmission lines 64*d* and 64*e* of the 3 dB coupler 64 are coupled through a symmetric-asymmetric line transformer 65, yet to be described, to transmission lines 65*d* and 65*e*, respectively, on the upper inner conductor of a two level asymmetric strip transmission line. Transmission line 65*d* is coupled at this level through a 45 degree phase shifter 66 to the input transmission line 67*a* of an interlevel 3 dB coupler 67, yet to be described via transmission line 68.

Interlevel 3 dB coupler 67 is a four port device having an input transmission line 67*a* and an output transmission line 67*b* at a common level, as for example, the upper level of a two inner level asymmetric transmission line and an input transmission line 67c and an output transmission line 67d at a different level, as for example, the lower level of a two level asymmetric stripline. The coupling between an input transmission line and the two output transmission lines is 3 dB with the signal in the common level output transmission line in-phase with the incident signal and the signal in the non-common level output transmission line in quadrature with the input signal. The output transmission lines 67b and 67d of interlevel coupler 67 are coupled to asymmetric-symmetric stripline transformer 70 wherein the transmission lines are coupled to a common level.

The output transmission line 65e from the symmetric-asymmetric transformer 65 at the upper level of the two level asymmetric transmission line is coupled via input transmission line 71a of interlevel 3 dB coupler 71 to a common level output transmission line 71b and to a lower level output transmission line 71d which in turn are coupled to asymmetric-symmetric transformer 70 wherein they are transformed to a common level. These common level transmission lines 67b', 71b', 67d' and 71d' are respectively coupled through element level transformer 16 to antenna elements 72a, 72c, 72e, and 72g.

Output transmission line 62b of symmetric stripline 3 dB coupler 62 is coupled via input transmission line 74a to a symmetric stripline 3 dB coupler 74 in the lower deck 14B, the output ports 74b and 74c of which are coupled via symmetric-asymmetric stripline transformer 75 to the upper and lower levels of a two level asymmetric stripline of the lower deck 14B. Transmission line 75d at the upper level of the asymmetric stripline is coupled to output transmission line 74b and is further coupled through a 45 degree phase shifter 76 to an interlevel 3 dB coupler 77, while output transmission line 75e, at the upper level of the asymmetric strip transmission line, is coupled to output transmission line 74c and is further coupled via input transmission line 81a to interlevel 3 dB coupler 81. The output port 77b of coupler 77 and the output port 81b of coupler 81 are at the upper level of the two level asymmetric stripline while the output ports 77d and 81d are at the lower level. These output ports are coupled to an asymmetric-symmetric stripline transformer 80 wherein they are transformed to a common level as the center conductors of a symmetric transmission line. The output symmetrical transmission lines 77b', 81b', 77d' and 81d' respectively couple the output transmission lines 77b, 81b, 77d, and 81d, through element transformer 16 to elements 72b, 72d, 72f, and 72h.

It will be recognized by those skilled in the art that a signal coupled to input terminal 61 will traverse the circuitry of FIG. 1 and provide a phase gradient across the array of elements 72a through 72h that is equal to $\pi/8$. A negative phase gradient of equal magnitude is realized when a signal is coupled to the second input port 91. This signal will be coupled to a symmetric stripline 3 dB coupler 92, and via output transmission lines 92a to a $67\frac{1}{2}°$ phase shifter 93 in the lower deck 14B via the deck level coupler 12. Simultaneously, a signal of equal amplitude as the signal coupled to a phase shifter 93 but in-phase quadrature therewith is coupled from the output transmission line 92b via the deck level coupler 12 to the input transmission line 94a of a symmetrical stripline 3 dB coupler 94 in the upper deck 14A. In deck 14B, a phase shifted signal from phase shifter 93 is coupled to an input port 95a of a symmetrical stripline 3 dB coupler 95. The output transmission lines 94c and 94b of 3 dB coupler 94 in deck 14A and 95c and 95b of 3 dB coupler 95 in deck 14B are respectively coupled to upper level input transmission lines 96a, 97a, 98a and 99a of 0 dB interlevel couplers 96, 97, 98 and 99 via symmetric-asymmetric transformers 102 and 103. These 0 dB couplers will couple a signal incident thereto at one level of an asymmetrical stripline, as for example transmission line 96a at the upper level of deck 14A, to a transmission line at a second level of an asymmetrical stripline, as for example transmission line 96b, with substantially zero attenuation and a phase shift in the order of 90 degrees. Thus, transmission line 96a is coupled to the input transmission line 67c of interlevel 3 dB coupler 67 via output transmission line 96b, accomplishing a level change without the utilization of interlevel pins and soldered connections. Similarly, transmission line 98a is coupled via transmission line 98b to the input transmission line 77c of 3 dB interlevel coupler 77 in deck 14B and transmission lines 97a and 99a in the upper level of deck 14A and deck 14B, respectively, are coupled via 0 dB interlevel couplers 97, 99, transmission lines 97b, 99b, and 45 degree phase shifters 104, 105 to the input transmission lines 71c, 81c of 3 dB interlevel couplers 71 and 81 on decks 14A and 14B, respectively. Signals coupled to input transmission lines 67c, 71c, 77c and 81c are coupled through interlevel 3 dB couplers 67, 71, 77 and 81, asymmetric-symmetric strip transmission line transformers 70 and 80 and element level transformer 16 to the array elements 72a through 72h.

Figure 2:
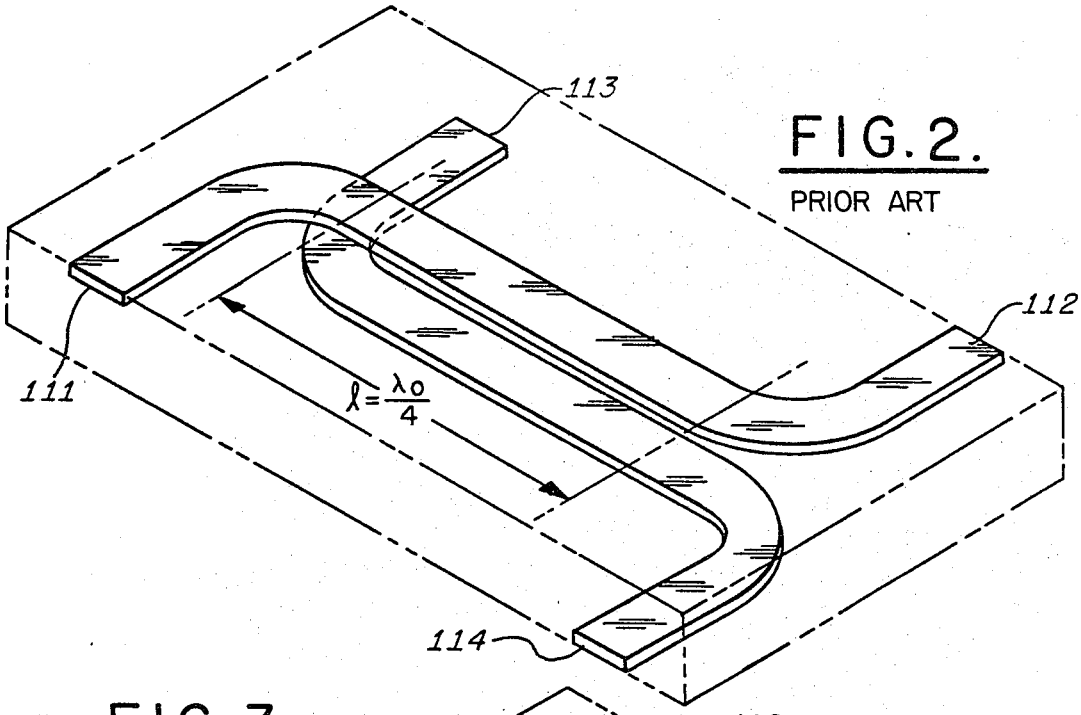
FIG. 2. PRIOR ART
FIG. 2 is a perspective view of the inner conductors of a stripline directional coupler.
Figure 3:
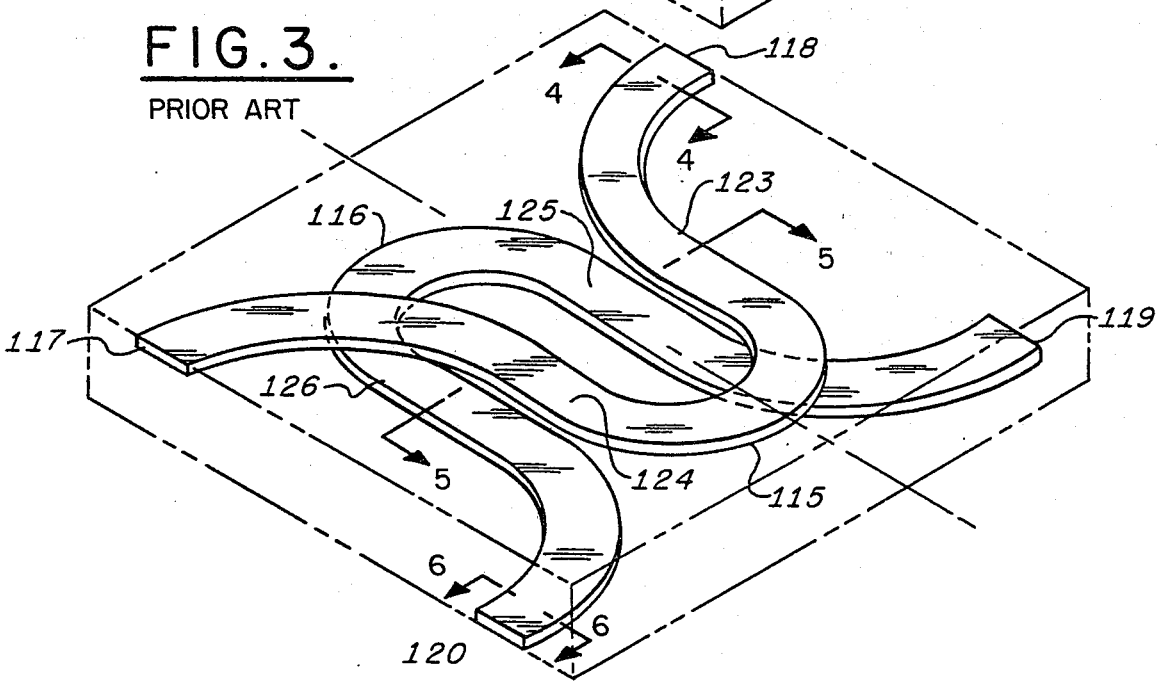
FIG. 3. PRIOR ART
FIG. 3 is a perspective view of the inner conductors of a 3 dB interlevel coupler.
Figure 4:
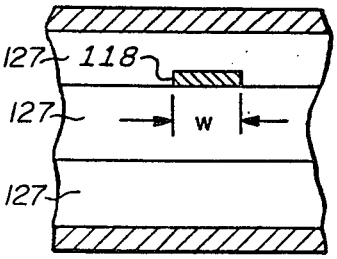
FIGS. 4 through 6 are cross-sectional views of selected sections of FIG. 3.
Figure 5:
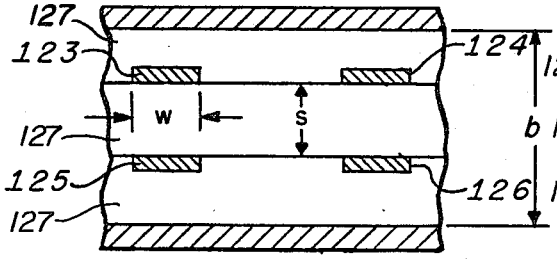
Figure 6:
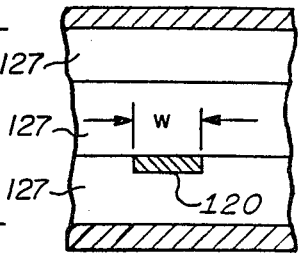

Interlevel 3 dB couplers 67,71, 77 and 81 may include two 8.3 dB stripline couplers of the type described by Gunderson and Guida in the Microwave Journal, Volume 8, Number 6, June 1965. A diagram of the inner conductors of this type coupler is shown in FIG. 2. This type coupler will couple a signal incident to the input transmission line 111 at one level of a two inner level stripline configuration to a common level output transmission line 112 and to a lower level output transmission line 113 with substantially no coupling to the forward direction lower level output transmission line 114. When a signal with a voltage $V_o$ is incident to transmission line 111 at a frequency for which the coupling length $l=\lambda/4$, this type of coupler, designed for $-8.3$ dB coupling between transmission lines 111 and 113, will couple a signal to transmission line 113 that is 0.385 $V_o$ and a signal to transmission line 112 that is 0.923 $V_o$ with a phase angle that is $-90°$ from that of the signal at transmission line 113. When two such couplers are placed in tandem as shown in FIG. 3, and the length of the interconnecting transmission lines 115 and 116 is properly chosen, a 3 dB coupler is realized between input transmission line 117 and output transmission lines 118 and 119 with the signal phase of the output transmission line 119 in quadrature with the signal phase of transmission lines 117 and 118. Substantially no signal is coupled to transmission line 120. FIGS. 4, 5, and 6 are cross-sectional views taken through three sections of the 3 dB interlevel coupler of FIG. 3, FIG. 4 representing the upper level output strip transmission line, FIG. 5 representing the striplines in the coupling region, and FIG. 6 representing the lower level output strip transmission line. When the material 127 used for spacing the inner and outer conductors is constructed of a foam dielectric with a dielectric constant substantially equal to 1.03 and the spacings between the upper level inner conductor and the upper ground plane is equal to the spacing between the lower level inner conductor and the lower level ground plane, a 50 ohm system may be realized when the spacing between the two inner conductors s, the spacing between the two ground planes b, and the width of the inner conductors w are in the relationships s/b=0.366 and w/b=1.4.

Figure 8:
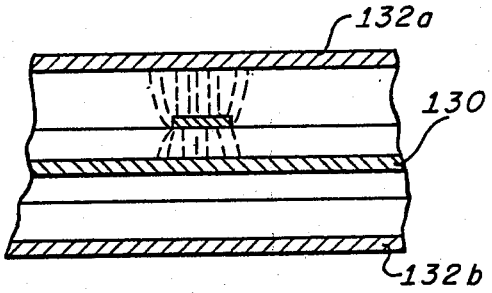
Figure 10:
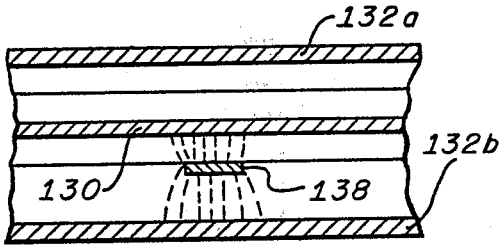

As stated previously, the desired characteristic of the interlevel 3 dB coupler is the positioning of the output ports at different stripline levels thus allowing lines to cross with minimum coupling therebetween and eliminating all interlevel pin connections normally associated with Butler matrices. To provide complete decoupling between crossing lines, the asymmetrical striplines may be converted to half height asymmetrical striplines by inserting a metallic sheet 130 at the midplane between the ground planes 132*a* and 132*b* as shown in FIGS. 8 and 10 in regions external to the coupling region of FIG. 3. Reducing the distance between the ground planes of the stripline circuits alters the distributed capacity of the system. Thus to maintain a constant characteristic impedance the distributed inductance of the system must be similarly altered. This is accomplished by reducing the width of the inner conductor, such as inner conductor 142 in FIG. 11, to one-half of its previous width.

Figure 7:
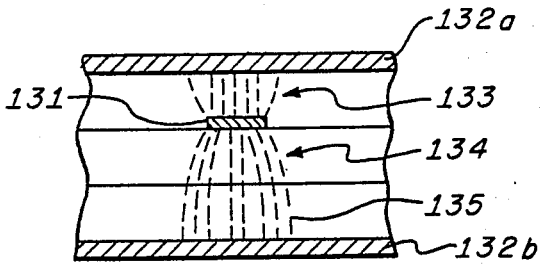
FIGS. 7 through 10 are cross-sectional views depicting transitions from full height asymetrical striplines to half height asymetrical stripline with electric field lines between the inner conductor and ground indicated thereon.
Figure 9:
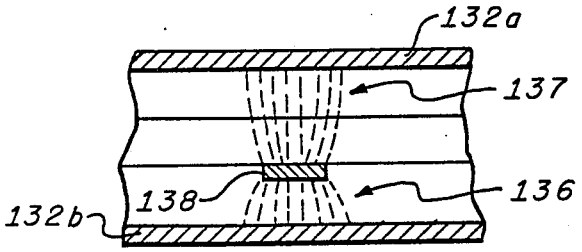
Figure 11:
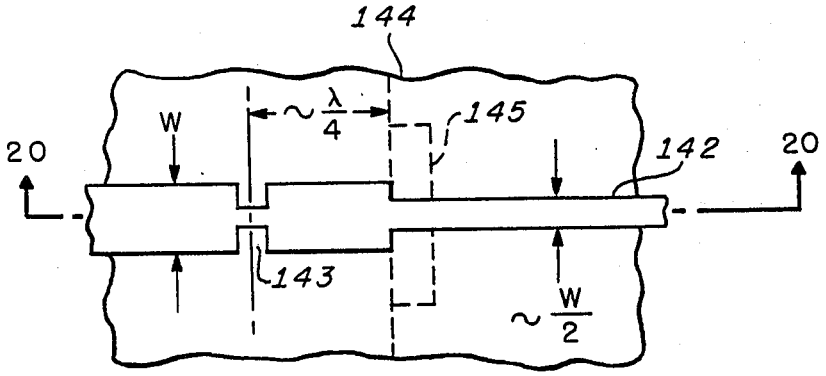
FIG. 11 is a plan view of a matching network useful for matching a full size asymmetric stripline to a half size asymmetric stripline.
Figure 12:
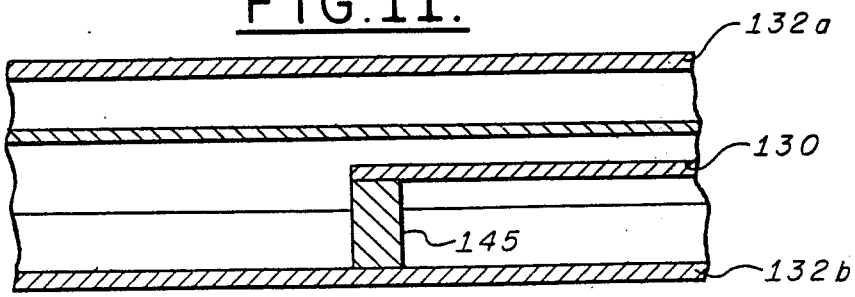
FIG. 12 is a cross-sectional view of the matching network of FIG. 11.

Referring now to FIG. 7, an upper level asymmetrical stripline with an inner conductor 131, which corresponds to the upper level strip transmission line 118 of FIG. 4, when excited, will establish the field lines 133 and 134 between the ground planes 132*a* and 132*b*, respectively. These field lines form an angle of 90 degrees with all metallic surfaces, as for example, the field line 135 with the ground plane 132*b*. If a metallic surface is inserted at a plane to which the field lines are perpendicular, the characteristic impedance is altered, but the system is otherwise unaltered. Insertion of a metallic sheet, in the strip transmission line region, i.e. external to the coupling region of FIG. 3, at the midplane to which the field lines are not perpendicular, alters the characteristic impedance of the line and also generates higher order modes. A similar situation exists with the lower level stripline in FIGS. 9 and 10. The field lines 136 and 137 created between the asymmetric inner conductor 138 and the ground planes 132*b* and 132*a*, respectively, are disturbed when the metallic sheet 130 is inserted mid-way between the ground planes 132*a* and 132*b*. Thus, the transformation from full size asymmetric stripline to half size asymmetric stripline requires impedance matching and mode suppression. This may be accomplished as shown in FIG. 11 by reducing the inner strip 142 in the half size stripline to be approximately half the width of the inner strip in the full size stripline and providing a reactance 143, in the output upper and lower level strip transmission lines, shown as an inductance in FIG. 11, approximately a quarter wavelength from the junction 144 between the full height and half height asymmetric striplines. To prevent the parallel plate mode from propagating between the inserted metallic ground plane and an original ground plane, as for example, between the ground planes 130 and 132*b* in FIG. 12, a metallic block 145 which makes good electrical contact with the ground planes 130 and 132*b* is inserted in the half height asymmetrical stripline with one edge substantially coincident with the junction 144.

Figure 13:
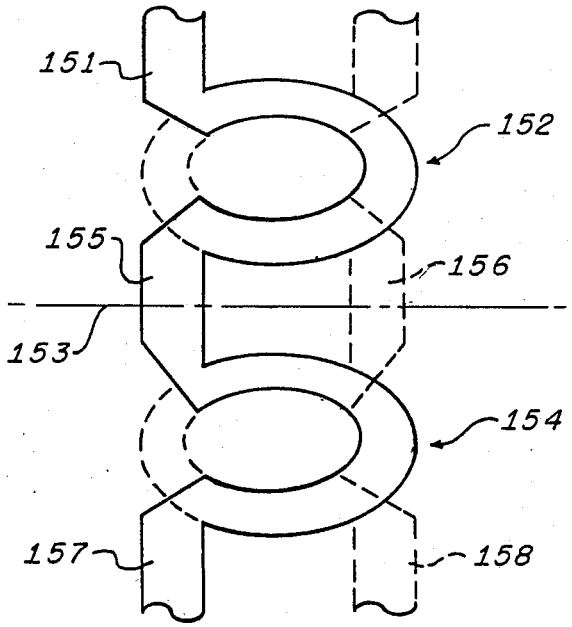
FIG. 13 is a plan view of 0 dB interlevel coupler showing two 3 dB interlevel couplers in tandem.

To accomplish a 0 dB level change, the 0 dB interlevel coupler may be designed as two interlevel 3 dB couplers, previously described, as shown in FIG. 13. In this arrangement, a signal with amplitude of $V_o$ coupled to an input transmission line 151 of the first 3 dB interlevel coupler 152 will couple at the junction 153 to the second 3 dB interlevel coupler 154 as a signal with an amplitude of 0.707 $V_o$ in the co-planar output transmission line 155 and as a signal with an amplitude of 0.707 $V_o$ at a phase angle of −90 degrees in the non-planar output transmission line 156. The signal in the co-planar output transmision line 155 couples across the junction 153 via interlevel 3 dB coupler 154 as a signal with an amplitude of 0.5 $V_o$ at a phase angle of 0 degree to the co-planar output transmission line 157 and as a signal with an amplitude of 0.5 $V_o$ at a phase angle of −90 degrees to the non-co-planar output transmission line 158. Similarly, the signal in the non-planar output transmission line 156 of interlevel 3 dB coupler 152 couples across the junction 153 via interlevel 3 dB coupler 154 to couple a signal with an amplitude of 0.5 $V_o$ at a phase angle of −180 degrees to co-planar output transmission line 157 and a signal with an amplitude of 0.5 $V_o$ at a phase angle of −90 degrees to non-co-planar output transmission line 158. Thus, the signals at the co-planar output transmission line 157 cancel while a signal with an amplitude of $V_o$ and a phase angle of −90 degrees is coupled to non-planar output transmission line 158 of 3 dB interlevel coupler 154. It should be apparent to those skilled in the art that a substantially 0 dB level change may also be accomplished be leaving the output transmission lines 118 and 119, of the four port device shown in FIG. 3, open circuited and utilizing transmission line 120 as the output transmission line on the second level. Those skilled in the art will recognize that these 0 dB interlevel couplers may be employed as interlevel transformers, asymmetric to symmetric line transformers, and deck level transformers.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. An apparatus for coupling signals between levels of multilevel stripline circuits comprising:

first and second ground planes having a region therebetween divided into three sections, a middle section, and two outer sections with first and second boundaries between said middle section and said two outer sections;

a first metallic inner conductor of horseshoe shape positioned at said first boundary, having an arcuate section, an open end, and first and second ports on either side of said open end respectively coupled to first and second metallic strip conductors at said first boundary;

a second metallic inner conductor of horseshoe shape positioned at said second boundary in an energy coupling relationship with said first horseshoe shaped inner conductor, having an arcuate section, an open end, and third and fourth ports on either side of said open end respectively coupled to third and fourth metallic strip conductors at said second boundary, said arcuate section and said open end of said second horseshoe shaped inner conductor respectively facing said open end and said arcuate section of said first horseshoe shaped inner conductor to position said first and third ports and said second and fourth ports with electrical distances therebetween; and first metallic means positioned substantially equidistant between said first and second ground planes and located in regions external to areas covered by said first and second horsehoe shaped inner conductors for providing common ground planes for strip conductors at said first and second boundaries to establish a first half height asymmetric stripline and a second half height asymmetric stripline.

2. An interlevel coupler in accordance with claim 1 wherein said electrical distance between said first and third ports and said electrical distance between said second and fourth ports is a quarter wavelength at a predetermined frequency within a preselected operating frequency band.

3. An interlevel coupler in accordance with claim 2 wherein said second and fourth ports are terminated with open circuits such that a signal incident to said first port is coupled to said third port substantially unattenuated.

4. An interlevel coupler in accordance with claims 1 or 2 further comprising:

A third metallic inner conductor of horseshoe shape having an arcuate section, an open end, and fifth and sixth ports on either side of said open end, positioned at said first boundary with said fifth port coupled to said second port and said sixth port coupled to said second metallic strip conductor;

a fourth metallic inner conductor of horseshoe shape having an arcuate section, an open end, and seventh and eighth ports on either side of said open end, positioned at said second boundary in an energy coupling relationship with said third metallic inner conductor, such that said arcuate section and open end of said fourth horseshoe shaped inner conductor respectively face said open end and arcuate section of said third horseshoe shaped inner conductor with said seventh port coupled to said fourth port, and said eighth port coupled to said third metallic strip conductor, said first, second, third and fourth horseshoe shaped inner conductors constructed and arranged such that a signal incident to port one is substantially unattenuatedly coupled to port eight and a signal incident to port three is substantially unattenuatedly coupled to port six.

5. An interlevel coupler in accordance with claims 1 or 2 wherein said first and second metallic inner conductors are constructed and arranged such that a signal incident to port one will couple with substantially equal amplitude between ports two and four.

6. An interlevel coupler in accordance with claims 1, 2, or 3 further including second metallic means positioned within at least one of said first and second asymmetric striplines electrically coupled to said common ground plane and to at least one of said first and second ground planes for preventing propagation of parallel plate modes.

7. An interlevel coupler in accordance with claim 4 further including second metallic means positioned within at least one of said first and second asymmetric striplines electrically coupled to said common ground plane and to at least one of said first and second ground planes for preventing propagation of parallel plate modes.

* * * * *